US008474610B1

(12) United States Patent
Knight et al.

(10) Patent No.: US 8,474,610 B1
(45) Date of Patent: Jul. 2, 2013

(54) PRODUCE CONTAINER WITH INSERT

(75) Inventors: Herbert T Knight, Genoa, IL (US); Danny Sean Curtis, Naperville, IL (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 13/432,137

(22) Filed: Mar. 28, 2012

(51) Int. Cl.
*B65D 81/26* (2006.01)
*B65D 1/36* (2006.01)

(52) U.S. Cl.
USPC ..... 206/204; 229/407; 426/124; 426/129

(58) Field of Classification Search
USPC ..... 206/204, 557; 229/406, 407; 426/124, 426/129
See application file for complete search history.

(56) References Cited

U.S. PATENT DOCUMENTS

| | | | | | |
|---|---|---|---|---|---|
| 3,155,303 | A * | 11/1964 | Fenkel | 229/407 |
| 3,563,445 | A * | 2/1971 | Clayton | 229/407 |
| 3,580,413 | A * | 5/1971 | Quackenbush | 229/407 |
| 3,834,606 | A * | 9/1974 | Andersson | 229/406 |
| 3,932,575 | A * | 1/1976 | Andersson | 264/154 |
| 4,057,651 | A * | 11/1977 | Florian | 426/129 |
| D249,234 | S * | 9/1978 | Limon et al. | D9/425 |
| 4,132,306 | A | 1/1979 | Margolin | |
| 4,533,585 | A * | 8/1985 | Holden | 229/407 |
| 4,552,600 | A * | 11/1985 | Laiewski et al. | 206/204 |
| 4,576,278 | A | 3/1986 | Laiewski et al. | |
| 5,705,213 | A * | 1/1998 | Guillin | 426/129 |
| 5,820,955 | A | 10/1998 | Brander | |
| 6,152,295 | A | 11/2000 | Brander et al. | |
| 6,376,034 | B1 | 4/2002 | Brander | |
| 6,478,147 | B1 | 11/2002 | Brander et al. | |
| 6,598,740 | B1 * | 7/2003 | Wiegers | 206/204 |
| 6,619,501 | B2 * | 9/2003 | Hayes et al. | 220/608 |
| 7,381,437 | B2 | 6/2008 | Brander | |
| 7,395,923 | B2 | 7/2008 | Chou | |
| 7,762,400 | B2 | 7/2010 | Hall et al. | |
| 7,776,416 | B2 | 8/2010 | Kinard et al. | |
| 7,921,992 | B2 | 4/2011 | LaRue et al. | |
| 8,104,635 | B2 * | 1/2012 | Hayes et al. | 220/675 |
| 2006/0219578 | A1 * | 10/2006 | Owensby | 206/204 |
| 2010/0176022 | A1 | 7/2010 | Furlong | |
| 2013/0095215 | A1 * | 4/2013 | Jensen et al. | 426/124 |

* cited by examiner

*Primary Examiner* — Bryon Gehman
(74) *Attorney, Agent, or Firm* — Miller, Matthias & Hull LLP

(57) ABSTRACT

An improved container for holding produce is provided. The container comprises a tub-like tray, an insert that forms a snap fit within the tray near the tray bottom wall, and an absorbent pad that fits in the space between the insert and the tray bottom wall. When in use, exuded liquid can drain into the reservoir below the insert where it is absorbed by the pad. The insert helps segregate the exuded liquid from the produce and is designed to remain in place when the container is titled.

8 Claims, 3 Drawing Sheets

Fig. 1
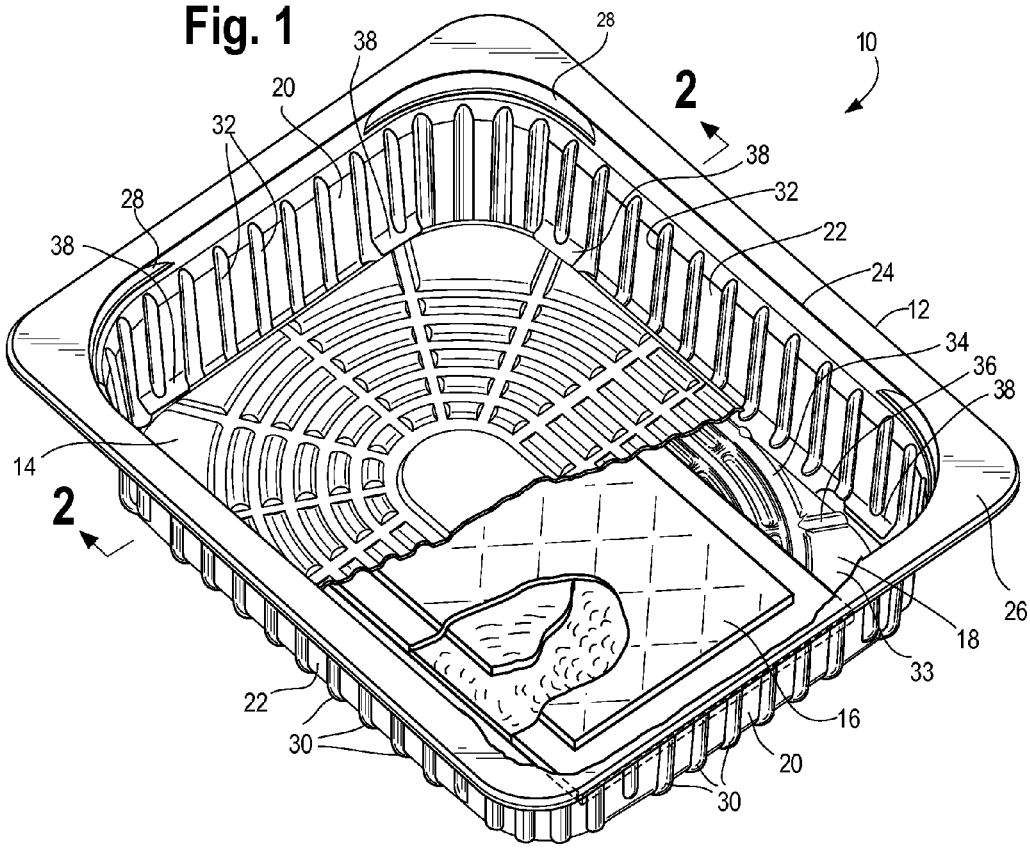
Fig. 2
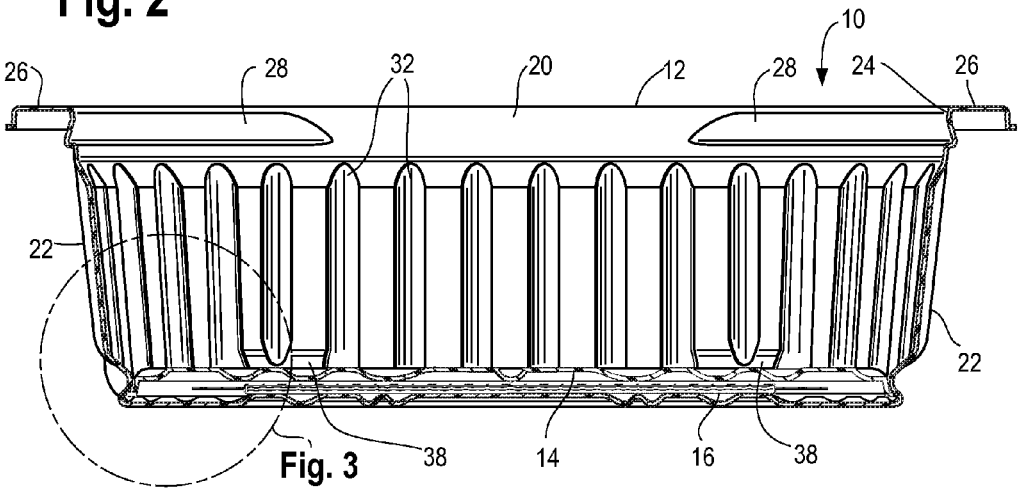
Fig. 3

PRODUCE CONTAINER WITH INSERT

BACKGROUND OF THE INVENTION

1. Field of the Invention

This invention patent relates to a produce container. More particularly, this invention relates to a container for storing cut produce and having a reservoir for holding accumulated liquids.

2. Description of the Related Art

When fresh whole produce (such as tomatoes) is cut during processing, liquid can be released over time. After the cut produce is packaged in a produce tray, this liquid can continue to accumulate in the bottom of the package which can be unsightly or, worse, hasten spoilage.

One current solution to this problem is to provide an insert that fits within the produce tray to create a liquid reservoir underneath the insert. Liquid from the produce drains through openings (located in the insert or, more typically, around the periphery of the insert) and into the reservoir, where it is kept separate from the produce. A disadvantage of this type of tray is that the liquid can contact the produce when the produce is poured from the tray or the tray is otherwise tilted or inverted.

It is therefore an object of the present invention to provide a produce container having an insert and in which liquid from the produce can drain through openings located around the periphery of the insert and into a reservoir.

It is another object of the invention to provide a produce container in which drained liquid is kept separate from the produce.

It is another object of the invention to provide a produce container in which any liquid drained into the reservoir does not contact the produce when the produce is poured from the container or the container is otherwise tilted or inverted.

Yet another object of the invention is to provide a produce container having a tray, an insert, and means for securing the insert within the tray.

Further and additional objects will appear from the description, accompanying drawings, and appended claims.

BRIEF SUMMARY OF THE INVENTION

The present invention is a container for holding cut produce. The container comprises a tub-like tray, an insert that forms a snap fit within the tray near the tray bottom wall, and an absorbent pad that fits in the space (reservoir) between the insert and the tray bottom wall. The insert is held in place by detents projecting inwardly from the tray sidewalls. When in use, exuded liquid can drain through vertical channels (fluted areas) in the tray sidewall into the reservoir below the insert where the liquid can be absorbed by the pad. The insert segregates the exuded liquid from the produce, and is designed to remain in place when the container is tilted.

In one embodiment of the invention the tray comprises a bottom wall having a perimeter and short and long sidewalls extending upwardly from the perimeter of the bottom wall and terminating at a substantially rectangular rim. The sidewalls have an inner, product facing surface. Vertically oriented, outwardly extending ribs may be molded into the tray sidewalls. The ribs define vertically oriented, concave flutes disposed on the inner surface (product facing side) of the sidewalls. The flutes extend from an upper portion of the tray sidewalls to the tray bottom wall, thereby providing channels through which exuded liquid can drain into the reservoir below the insert.

The tray further comprises a plurality of inwardly directed locking detents located along a lower portion of the tray sidewalls just above the bottom wall. The detents may be substantially wedged shaped and comprise a sloped upper surface and a sloped lower surface adjoined at a horizontal apex. The insert snaps into place below the detents and is held in place even when the container is titled. The tray may further comprise a flange extending horizontally outward from the rim and configured to hold a lid.

The insert fits within the tray to define a reservoir located between the insert and the tray bottom wall. The insert comprises a substantially planar upper surface terminating in a substantially rectangular peripheral edge, short and long sidewalls extending downward from the peripheral edge and terminating at a substantially rectangular lower edge, and a flange extending horizontally outward from the lower edge.

In a key aspect of the invention the insert is secured within the tray by positioning the insert flange under the tray detents. This requires some bending (deformation) of the insert and/or the tray.

In another key aspect of the invention the insert and the flutes define a plurality of discrete openings or channels located around the periphery of the insert which allow liquid to drain into the reservoir.

The tray bottom wall may be contoured and comprise a substantially planar lower surface and raised areas extending above the lower surface. The raised areas define channels or depressions into which the absorbent pad can expand as it absorbs liquid.

Likewise, the insert may be contoured and comprise a substantially planar surface and lowered areas extending below the planar surface. The lowered areas define raised channels or spaces into which the absorbent pad can expand as it absorbs liquids. The insert may be formed or otherwise shaped substantially like a minor image of the tray bottom wall.

BRIEF DESCRIPTION OF THE DRAWINGS

FIG. 1 is a perspective view of a produce container according to the invention.

FIG. 2 is a cross-sectional view of the produce container of FIG. 1 taken along line 2-2.

DETAILED DESCRIPTION OF THE INVENTION

Figure 3:
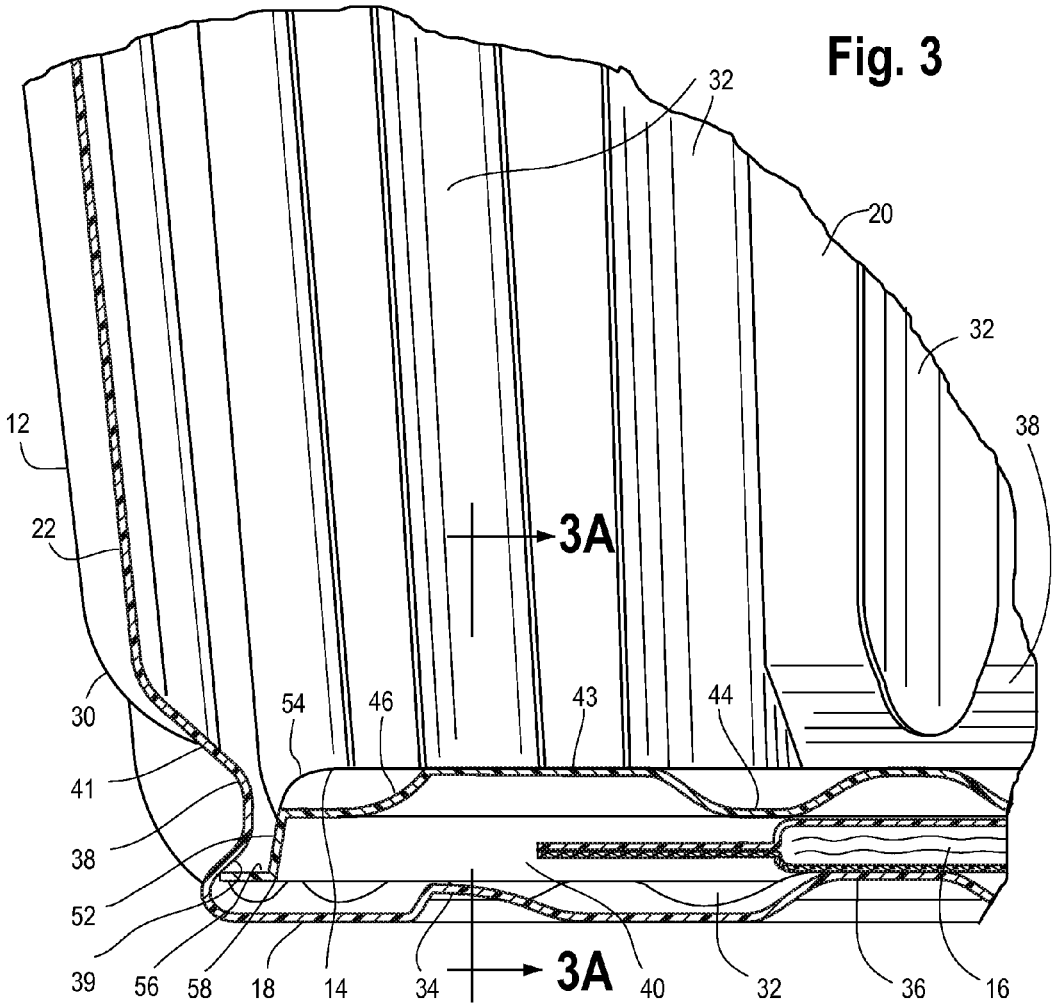
FIG. 3 is a close up view of a portion of the produce container of FIG. 2.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Turning to the drawings, there is shown in FIGS. 1 to 4 one embodiment of the present invention, a container 10 for holding produce (P), particularly cut produce such as sliced tomatoes. The container 10 comprises a tub-like tray 12, an insert 14 that fits within the tray 12 near the tray bottom wall 18, and an absorbent pad 16 that fits in the space ("reservoir") between the insert 14 and the tray bottom wall 18.

In addition to the bottom wall 18, the tray 12 comprises short and long sidewalls 20, 22 extending upwardly from the perimeter of the bottom wall 18. The sidewalls 20, 22 terminate at a substantially rectangular rim 24. A flange 26 extends horizontally outward from the rim 24 and may be configured to hold a lid (not shown). Horizontally oriented stacking grooves 28 disposed along the four corners of the tray 12 facilitate stacking of multiple trays 12. Although the tray 12 as shown and described herein is rectangular, the tray may also be square.

The sidewalls 20, 22 may comprise a plurality of integrally formed, vertically oriented, outwardly extending ribs 30. The ribs 30, being convex when viewed from the tray exterior, define vertically oriented concave flutes 32 on the inner surfaces of the sidewalls 20, 22. These flutes 32 extend downward from above the insert 14, and preferably from an upper position of the tray 12 near the tray top edge 24, to the tray bottom wall 18. In this way the flutes 32 serve as channels through which exuded liquid can drain into the reservoir 40 below the insert 14.

The tray bottom wall 18 may be contoured and may include a substantially planar lower surface 33, substantially oval raised areas 34 and radially oriented linear raised areas 36 intersecting the oval raised areas 34. The raised areas 34, 36 extend above the lower surface 33.

The tray 12 further includes a plurality of inwardly directed horizontally oriented locking detents 38 located along a lower portion of the tray sidewalls 20, 22 just above the bottom wall 18. These detents 38 are substantially wedged shaped and comprise a sloped upper surface 41 and a sloped lower surface (undercut) 39 that meet at a horizontal apex and are designed to capture the insert 14 and hold it in place as best shown in FIG. 3.

Figure 3A:
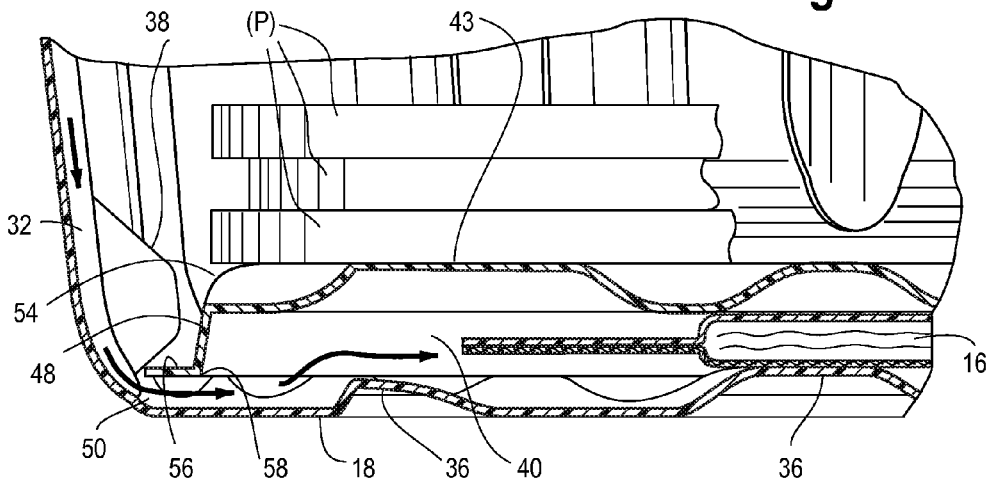
FIG. 3A is a cross sectional view of the produce container of FIG. 3 taken along line 3A-3A, with some produce (sliced tomatoes) added to show the flow of liquid from the produce into the reservoir.
Figure 4:
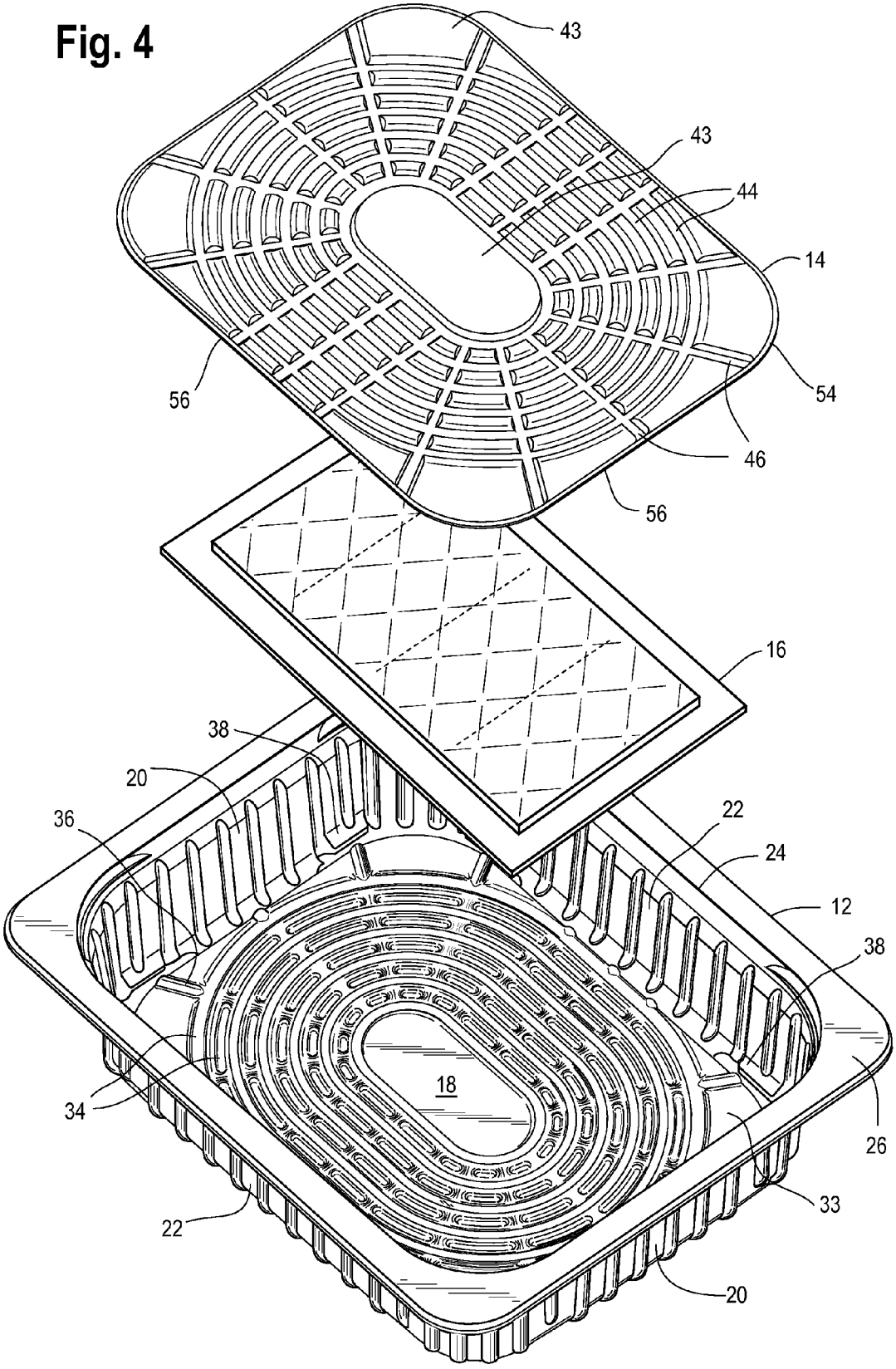
FIG. 4 is an exploded view of the produce container of FIG. 1.

The insert 14 may be semi-rigid so that it can be deformed to fit below the detents 38 when inserted into the tray 12 and still support the weight of produce (P) on top. The insert 14 fits within the tray 12 to help define the space or reservoir 40 located between the insert 14 and the tray bottom wall 18 (FIGS. 3 and 3A). The insert 14 may be shaped like a minor image of the tray bottom wall 18, and so may comprise a substantially planar upper surface 43, substantially oval lowered (i.e., downwardly extending) areas 44 and radially oriented linear lowered (i.e., downwardly extending) areas 46 intersecting the oval lowered areas 44. The lowered areas 44, 46 extend below the planar surface 43. The lowered (contoured) areas 44, 46 add strength and facilitate the flow of liquid to the periphery of the insert 14 as indicated by the arrows in FIG. 3A.

The substantially planar upper surface 43 terminates in a substantially rectangular, rounded peripheral edge 54. Short and long sidewalls 48, 52 extend downward from the peripheral edge 54 and terminate at a substantially rectangular rounded lower edge 58. A flange 56 extends horizontally outwardly from the lower edge 58 and may be continuous around the entire insert 14.

The absorbent pad 16 is conventional and may be of the kind currently used in food packaging, including meat packaging. By way of example only, the pad 16 may comprise an absorbent compound sandwiched between two sheets of material, wherein at least one sheet is liquid permeable.

Assembling the Produce Container 10

The produce container 10 may be assembled as follows. First the absorbent pad may be placed inside the tray 12 so that it rests on the tray bottom wall 18 or, more particularly, the raised areas 34, 36 of the tray bottom wall 18.

Next, the insert 14 is placed within the tray and is locked into place above the absorbent pad 16. To secure the insert 14 within the tray 12, the insert flange 56 must be snapped into place under the tray detents 38 so that the flange 56 is held down by the undercuts 39 as best shown in FIG. 3. This arrangement locks the insert 14 in place and prevents it (and the pad 16) from falling out or becoming dislodged when the container 10 is tilted.

When the insert 14 is locked into place, the insert 14 and tray 12 define a reservoir 40 between the insert 14 and the tray bottom wall 18. As best shown in FIG. 3A, the insert 14 and tray 12 also define numerous discrete channels or openings 50 around the periphery of the insert 14 which allow liquids to enter the reservoir 40. More particularly, these channels 50 coincide with the areas where the insert 14 meets the vertical flutes 32.

The insert 14 rests on the tray bottom wall 18 as shown in FIG. 3 or, more particularly, on the raised areas 34, 36 of the tray bottom wall 18. And since the sidewalls 48, 52 (and thus the flange 56) extend below the lowered areas 44, 46 of the insert 14, only the insert flange 56 touches the bottom wall 18.

Also, since the lowered areas 44, 46 of the insert 14 generally align with the raised areas 34, 36 of the tray bottom wall 18, the other ("non-lowered") surfaces of the insert 14 and the other ("non-raised") areas of the bottom wall 18 will also align to define channels and other spaces into which the absorbent pad 16 can expand.

It should be noted that the lowered areas 44, 46 of the insert 14 and the raised areas 34, 36 of the tray bottom wall 18 may assume any variety of configurations, although preferably they assume the same configuration.

Using the Produce Container 10

As noted above, the produce container 10 may be used to store and carry fresh whole or cut produce (such as tomatoes) or other foods that release liquid over time. After the cut produce is packaged in the container 10, any exuded liquids will drain into the reservoir 40 and be absorbed by the pad 16.

When in use, the channels 50 located around the periphery of the insert 14 (i.e., between the insert flange 56 and the tray side walls 20, 22 and coincident with the vertical flutes 32) allow the liquid to drain into the reservoir 24 where the liquid can be absorbed by the pad 16. The reservoir 40, i.e., the space between the tray 12 and the insert 14, is sized to accommodate significant expansion of the pad 16 as it absorbs liquid, especially, as noted above, in the channel and other spaces defined by the "non-lowered" surfaces of the insert 14 and the "non-raised" areas of the bottom wall 18.

As the pad absorbs liquid is can increase in thickness. It has been found that the pad 16 can absorb as much as 125 ml of liquid and expand as much as 1 cm in thickness. The pad 16 can expand into the spaces defined by the "non-lowered" surfaces of the insert 14 and the "non-raised" areas of the bottom wall 18.

Thus there has been described an improved container 10 for holding produce (P). The container 10 comprises a tub-like tray 12, an insert 14 that fits within the tray 12 near the tray bottom wall 18, and an absorbent pad 16 that fits in the space between the insert 14 and the tray bottom wall 18. The insert 14 is held in place by detents 38 located in the tray 12. When in use, exuded liquid can drain along vertical channels (fluted areas) 32 in the tray, past the insert 14 and into the reservoir 24 below the insert 14 where the liquid is absorbed by the pad 16. The insert 14 helps segregate the exuded liquid from the produce (P), and is designed to remain in place when the container 10 is tilted.

It should be understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

We claim as our invention:

1. A produce container comprising:

a tray comprising a bottom wall having a perimeter, and short sidewalls and long sidewalls extending upwardly from the perimeter of the bottom wall and terminating at a substantially rectangular rim; the sidewalls having an inner, product facing surface and comprising vertically oriented, outwardly extending ribs, the ribs defining vertically oriented concave flutes disposed on the inner surfaces of the sidewalls, the flutes extending from an upper portion of the tray sidewalls to the tray bottom wall; the tray further comprising a plurality of inwardly directed locking detents located along a lower portion of the tray sidewalls just above the bottom wall; and an insert that fits within the tray to define a reservoir located between the insert and the tray bottom wall, the insert comprising a substantially planar upper surface terminating in a substantially rectangular peripheral edge, short and long sidewalls extending downward from the peripheral edge and terminating at a substantially rectangular lower edge, and a flange extending horizontally outward from the lower edge;

wherein the insert is secured within the tray by positioning the insert flange under the locking detents; and wherein the insert and the flutes define a plurality of discrete channels located around the periphery of the insert which channels direct liquids to enter the reservoir.

2. The produce container of claim 1 further comprising an absorbent pad disposed in the reservoir.

3. The produce container of claim 2 wherein the tray bottom wall comprises a substantially planar lower surface and raised areas extending above the lower surface, the raised areas defining depressions into which the absorbent pad can expand as it absorbs liquids.

4. The produce container of claim 3 wherein the insert comprises a substantially planar surface and substantially lowered areas extending below the planar surface, the lowered areas defining indentations into which the absorbent pad can expand as it absorbs liquids.

5. The produce container of claim 4 wherein the insert is shaped substantially like a minor image of the tray bottom wall.

6. The produce container of claim 1 wherein the locking detents are substantially wedge shaped and comprise a sloped upper surface and a sloped lower surface.

7. The produce container of claim 1 wherein the tray further comprises a flange extending horizontally outward from the rim and configured to hold a lid.

8. The produce container of claim 1 wherein the tray further comprises four corners and horizontally oriented stacking grooves disposed along the four corners of the tray to facilitate stacking of multiple produce containers.

* * * * *